US008873775B2

(12) United States Patent
Wei et al.

(10) Patent No.: US 8,873,775 B2
(45) **Date of Patent: *Oct. 28, 2014**

(54) THERMOACOUSTIC DEVICE

(71) Applicants: Tsinghua University, Beijing (CN); Hon Hai Precision Industry Co., Ltd., New Taipei (TW)

(72) Inventors: Yang Wei, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/923,327

(22) Filed: Jun. 20, 2013

(65) Prior Publication Data

US 2014/0185840 A1 Jul. 3, 2014

(30) Foreign Application Priority Data

Dec. 29, 2012 (CN) ..... 2012 1 05876889

(51) Int. Cl.
*H04R 25/00* (2006.01)

(52) U.S. Cl.
USPC ..... 381/164; 381/150

(58) Field of Classification Search
CPC ..... H04R 25/00; H04R 1/00
USPC ..... 381/150, 164
See application file for complete search history.

(56) References Cited

U.S. PATENT DOCUMENTS

| | | | | |
|---|---|---|---|---|
| 8,019,097 | B2 * | 9/2011 | Jiang et al. | 381/164 |
| 8,019,098 | B2 * | 9/2011 | Jiang et al. | 381/164 |
| 8,019,099 | B2 * | 9/2011 | Jiang et al. | 381/164 |
| 8,300,854 | B2 * | 10/2012 | Jiang et al. | 381/164 |
| 8,331,586 | B2 * | 12/2012 | Jiang et al. | 381/164 |
| 8,625,822 | B2 * | 1/2014 | Jiang et al. | 381/164 |
| 2012/0250907 | A1 | 10/2012 | Jiang et al. | |

FOREIGN PATENT DOCUMENTS

| | | |
|---|---|---|
| JP | 4-180744 | 6/1992 |
| JP | 2005-304692 | 11/2005 |
| JP | 2012-209923 | 10/2012 |

* cited by examiner

*Primary Examiner* — Suhan Ni
(74) *Attorney, Agent, or Firm* — Novak Druce Connolly Bove + Quigg LLP

(57) ABSTRACT

A thermoacoustic device comprise a substrate, a number of thermoacoustic units on the substrate, a number of switches, a driving integrated circuit, a scanning integrated circuit, and a common electrode. The switches are electrically connected to the thermoacoustic units. Each of the switches is electrically connected in series between the first electrode and the driving integrated circuit through a driving electrode. Each of the switches is electrically connected to the scanning integrated circuit through a scanning electrode. The common electrode is electrically connected to the second electrode of the number of thermoacoustic units.

20 Claims, 9 Drawing Sheets

THERMOACOUSTIC DEVICE

RELATED APPLICATIONS

This application claims all benefits accruing under 35 U.S.C. §119 from China Patent Application No. 201210587688.9, filed on Dec. 29, 2012 in the China Intellectual Property Office, the contents of which are hereby incorporated by reference.

BACKGROUND

1. Technical Field

The present disclosure relates to thermoacoustic devices.

2. Description of Related Art

An acoustic device generally includes an electrical signal output device and a loudspeaker. The electrical signal output device inputs electrical signals into the loudspeaker. The loudspeaker receives the electrical signals and then transforms them into sounds.

There are different types of loudspeakers that can be categorized according by their working principles, such as electro-dynamic loudspeakers, electromagnetic loudspeakers, electrostatic loudspeakers, and piezoelectric loudspeakers.

Thermoacoustic effect is a conversion of heat to acoustic signals. The thermoacoustic effect is distinct from the mechanism of the conventional loudspeaker, which the pressure waves are created by the mechanical movement of the diaphragm. When signals are inputted into a sound wave generator, heating is produced in the sound wave generator according to the variations of the signal and/or signal strength. Heat is propagated into surrounding medium. The heating of the medium causes thermal expansion and produces pressure waves in the surrounding medium, resulting in sound wave generation. Such an acoustic effect induced by temperature waves is commonly called "the thermoacoustic effect."

Carbon nanotubes (CNT) are a novel carbonaceous material having an extremely small size and an extremely large specific surface area. Carbon nanotubes have received a great deal of interest since the early 1990s, and have interesting and potentially useful electrical and mechanical properties, and have been widely used in a plurality of fields. The carbon nanotube film used in the thermoacoustic device has a large specific surface area, and extremely small heat capacity per unit area that make the sound wave generator emit sound audible to humans. However, the carbon nanotube film used in the thermoacoustic device has a small thickness and a large area, and is likely to be damaged by the external forces applied thereon.

What is needed, therefore, is to provide a thermoacoustic device for solving the problem discussed above.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

References will now be made to the drawings to describe, in detail, various embodiments of the present thermoacoustic devices.

Figure 1:
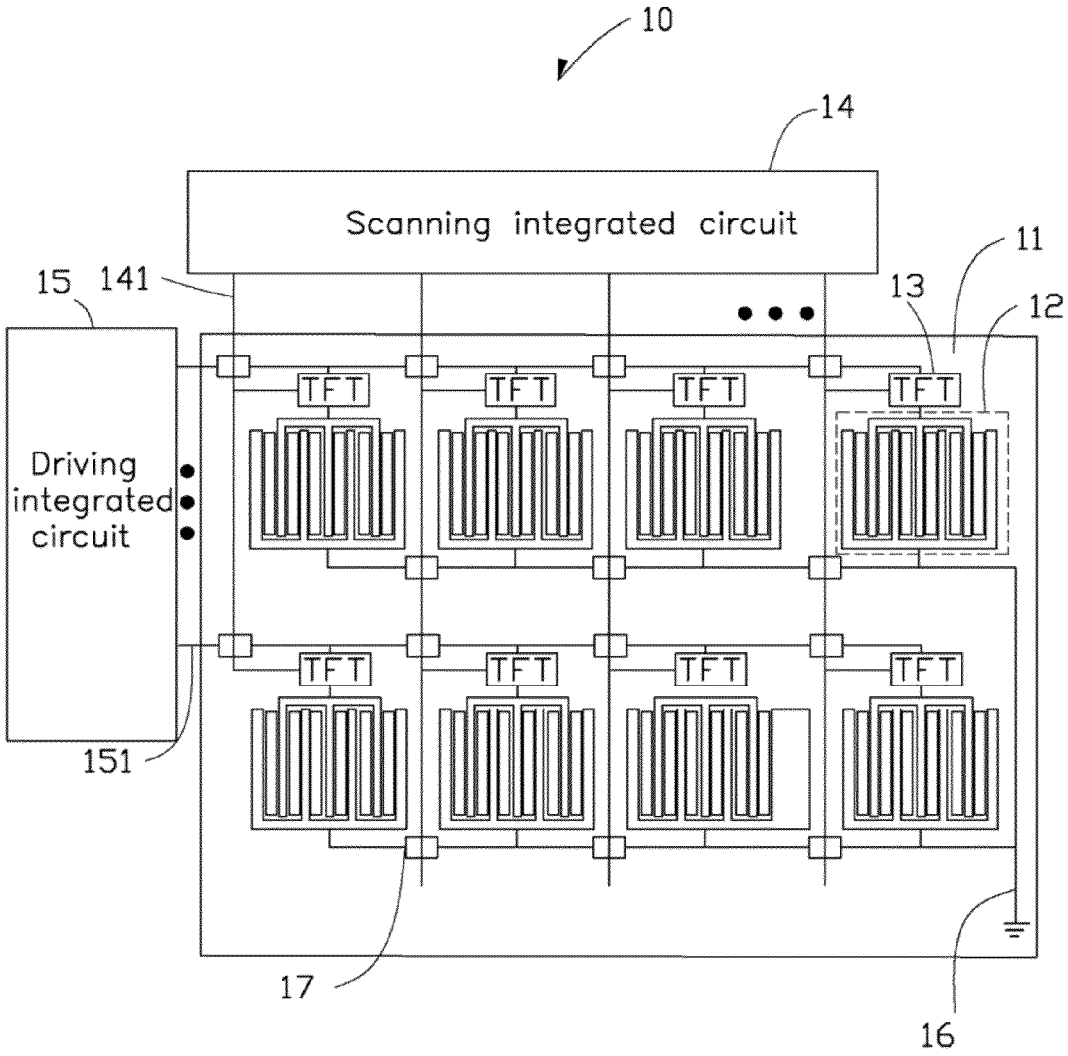
FIG. 1 is a schematic view of one embodiment of a thermoacoustic device.

Referring to FIG. 1, a thermoacoustic device 10 includes a substrate 11, a plurality of thermoacoustic units 12, a plurality of switches 13, a scanning integrated circuit 14, a driving integrated circuit 15, and a common electrode 16. Each of the plurality of the thermoacoustic units 12 is electrically connected to one of the plurality of switches 13 and the common electrode 16. The plurality of switches 13 are electrically connected to the scanning integrated circuit 14 and the driving integrated circuit 15 to receive control signals. The plurality of switches 13 is configured to control the working status of the plurality of thermoacoustic units 12 respectively.

The substrate 11 can be a flake-like structure. The shape of the substrate 11 can be circular, square, rectangular, or other geometric figure. The resistance of the substrate 11 is greater than the resistance of the thermoacoustic unit 12 to avoid a short through the substrate 11. The substrate 11 can have a good thermal insulating property, thereby preventing the substrate 11 from absorbing heat generated by the thermoacoustic unit 12. The material of the substrate 11 can be single crystal silicon or multicrystalline silicon. The size of the substrate 11 can range from about 25 square millimeters to about 100 square millimeters. In one embodiment, the substrate 11 is a single crystal silicon with a thickness of about 0.6 millimeters, and a length of each side of the substrate 11 is about 8 millimeters.

Figure 2:
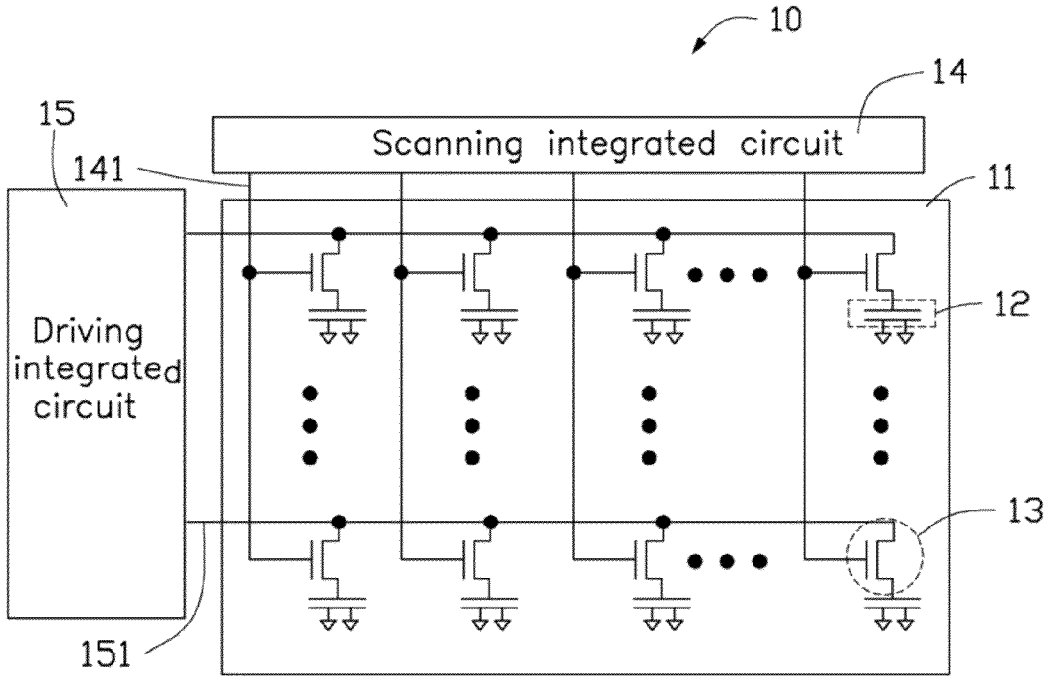
FIG. 2 is an equivalent circuit diagram of the thermoacoustic device of FIG. 1.

Referring also to FIG. 2, the thermoacoustic device 10 further includes a plurality of driving electrodes 151 substantially parallel with each other, and a plurality of scanning electrodes 141 substantially parallel with each other. The plurality of scanning electrodes 141 is intersected and insulated from the plurality of driving electrodes 151. In one embodiment, the plurality of scanning electrodes 141 is substantially perpendicular with the plurality of driving electrodes 151, and insulated from the driving electrodes 151 via an insulated spacer 17. A material of the insulated spacer 17 can be $SiO_2$, $Si_3N_4$, or a combination of both. The material of the insulated spacer 17 can also be other insulating materials.

Each of the plurality of driving electrodes 151 includes a first end and a second end opposite to the first end. The first end is electrically connected to the driving integrated circuit 15, and the second end is electrically connected to one of the plurality of switches 13. Each of the plurality of scanning electrodes 141 includes a third end electrically connected to the scanning integrated circuit 14, and a fourth end electrically connected to one of the plurality of switches 13. A grid is defined by two adjacent scanning electrodes 141 and two adjacent two driving electrodes 151. The thermoacoustic unit 12 is received in the grid.

The common electrode 16 is insulated from the plurality of scanning electrodes 141 and the plurality of driving electrodes 151. The common electrode 16 can be substantially parallel with the plurality of driving electrodes 151. The common electrode 16 is configured to supply a relative low potential. In one embodiment, the common electrode 16 is grounded.

The plurality of switches 13 is electrically connected to the plurality of thermoacoustic units 12, respectively. Each of the plurality of switches 13 is electrically connected to one thermoacoustic unit 12 to connect or break contacts between the driving integrated circuit 15 and the thermoacoustic unit 12. The switch 13 can be switched on or switched off by the scanning integrated circuit 16 to apply or cut the driving voltage to the thermoacoustic unit 12. The switch 13 can be a triode, such as a transistor or field effect transistor. In one embodiment, the switch 13 is a thin film transistor (TFT). The thin film transistor includes a source electrode, a drain electrode, and a gate electrode. The source electrode of the thin film transistor is electrically connected to the driving electrode 151, the drain electrode is electrically connected to the thermoacoustic unit 12, and the gate electrode is electrically connected to the scanning electrode 141. The gate electrode is controlled by the scanning integrated circuit 14. The connection or break between the source electrode and the drain electrode is controlled by a supply voltage to the gate electrode through the scanning integrated circuit 14.

Figure 3:
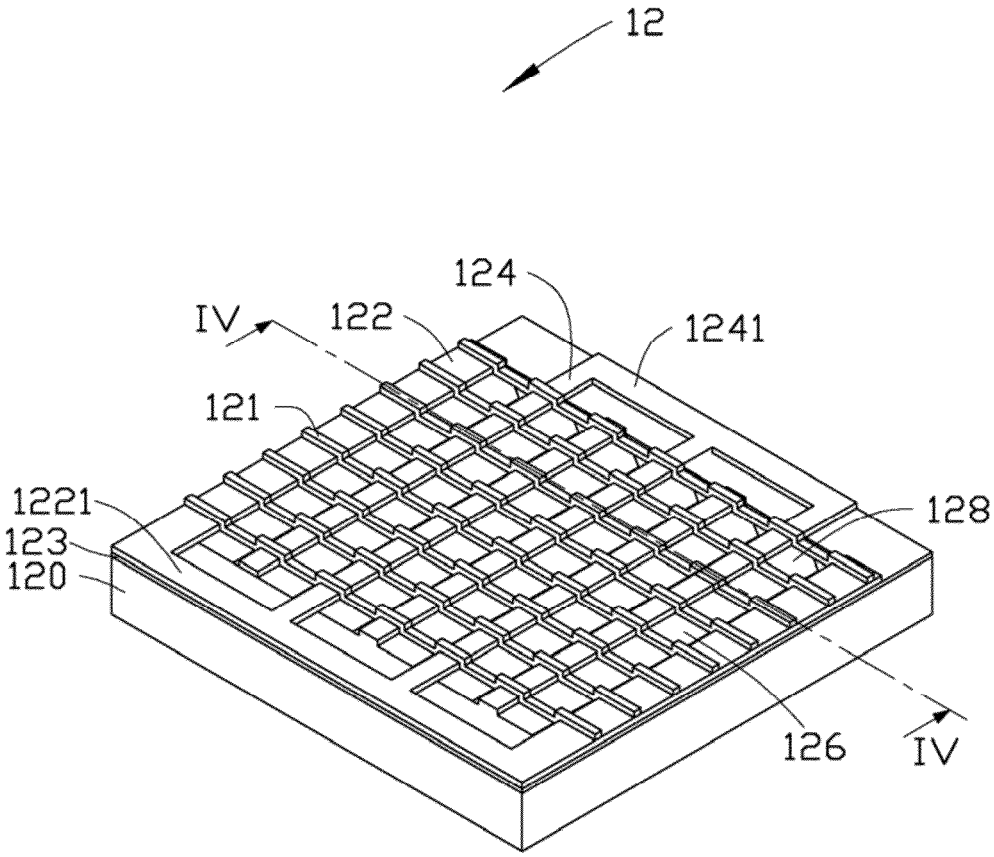
FIG. 3 is an isometric view of a thermoacoustic unit in the thermoacoustic device of FIG. 1.
Figure 4:
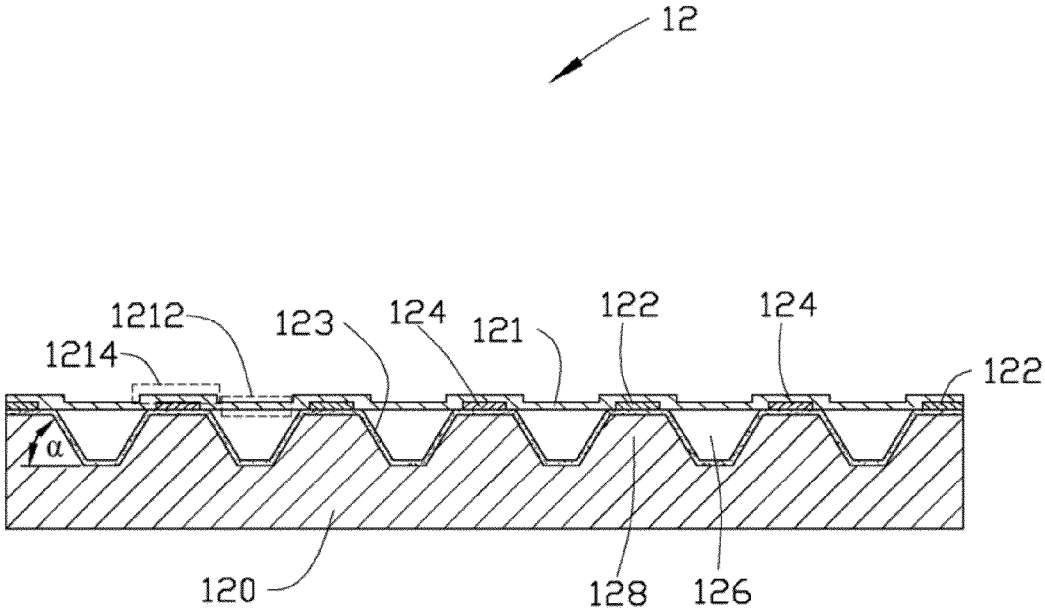
FIG. 4 is a cross-sectional view, along a line IV-IV of FIG. 3.

Further referring to FIGS. 3-4, each of the plurality of thermoacoustic units 12 includes a sound wave generator 121, a plurality of first electrodes 122, and a plurality of second electrodes 124. The sound wave generator 121 can be located on the substrate 11 and insulated from the substrate 11 through an insulating layer 123. A plurality of grooves 126 is defined on a surface of the substrate 11, and a bulge 128 is formed between each two adjacent grooves 126. The insulating layer 123 is continuously attached on the plurality of grooves 126 and the bulge 128. The sound wave generator 121 defines a first portion 1212 and a second portion 1214. The first portion 1212 is suspended on the plurality of grooves 126. The second portion 1214 is attached on the bulge 128.

The plurality of grooves 126 can be uniformly dispersed on the surface of the substrate 11 such as dispersed in an array. The plurality of grooves 126 can also be randomly dispersed. In one embodiment, the plurality of grooves 126 extends along the same direction, and spaced from each other a certain distance. The shape of the groove 126 can be a through hole, a blind groove (i.e., a depth of the groove 126 is less than a thickness of the substrate 11), or a blind hole. In one embodiment, the shape of the groove 126 is a blind groove, and each of the grooves 126 can include a bottom and a sidewall adjacent to the bottom. The first portion 1212 is spaced from the bottom and the sidewall.

A depth of the groove 126 can range from about 100 micrometers to about 200 micrometers. The sound waves reflected by the bottom surface of the blind grooves can have a superposition with the original sound waves, which can lead to interference cancellation. To reduce this impact, the depth of the blind grooves can be less than about 200 micrometers. In another aspect, if the depth of the blind grooves is less than 100 micrometers, the heat generated by the thermoacoustic unit 12 would be dissipated insufficiently. To reduce this impact, the depth of the blind grooves and holes can be greater than 100 micrometers.

The plurality of grooves 126 can be substantially parallel with each other and extend substantially along the same direction. A distance $d_1$ between adjacent grooves 126 can range from about 20 micrometers to about 200 micrometers. Thus the first electrode 106 and the second electrode 124 can be printed on the substrate 11 via a nanoimprinting method. A cross section of the groove 126 along the extending direction can be V-shaped, rectangular, or trapezoid. In one embodiment, a width of the groove 126 can range from about 0.2 millimeters to about 1 micrometer. Thus, the sound wave generator 121 can be prevented from being broken. Furthermore, a driving voltage of the thermoacoustic unit 12 can be reduced to lower than 12V. In one embodiment, the driving voltage of the thermoacoustic unit 12 is lower than or equal to 5V. In one embodiment, the shape of the groove 126 is trapezoid. An angle $\alpha$ is defined between the sidewall and the bottom. The angle $\alpha$ is equal to the crystal plane angle of the substrate 11. In one embodiment, the width of the groove 126 is about 0.6 millimeters, the depth of the groove 126 is about 150 micrometers, the distance $d_1$ between adjacent two grooves 126 is about 100 micrometers, and the angle $\alpha$ is about 54.7 degrees.

The insulating layer 123 can be a single-layer structure or a multi-layer structure. In one embodiment, the insulating layer 123 can be merely located on the plurality of bulges 128. In another embodiment, the insulating layer 123 is a continuous structure, and attached on the entire first surface 101. The insulating layer 123 covers the plurality of grooves 126 and the plurality of bulges 128. The thermoacoustic unit 12 is insulated from the substrate 11 by the insulating layer 123. In one embodiment, the insulating layer 123 is a single-layer structure and covers the entire first surface 101.

The material of the insulating layer 123 can be $SiO_2$, $Si_3N_4$, or a combination of both. The material of the insulating layer 123 can also be other insulating materials. A thickness of the insulating layer 123 can range from about 10 nanometers to about 2 micrometers, such as about 50 nanometers, about 90 nanometers, and about 1 micrometer. In one embodiment, the thickness of the insulating layer is about 1.2 micrometers.

Figure 5:
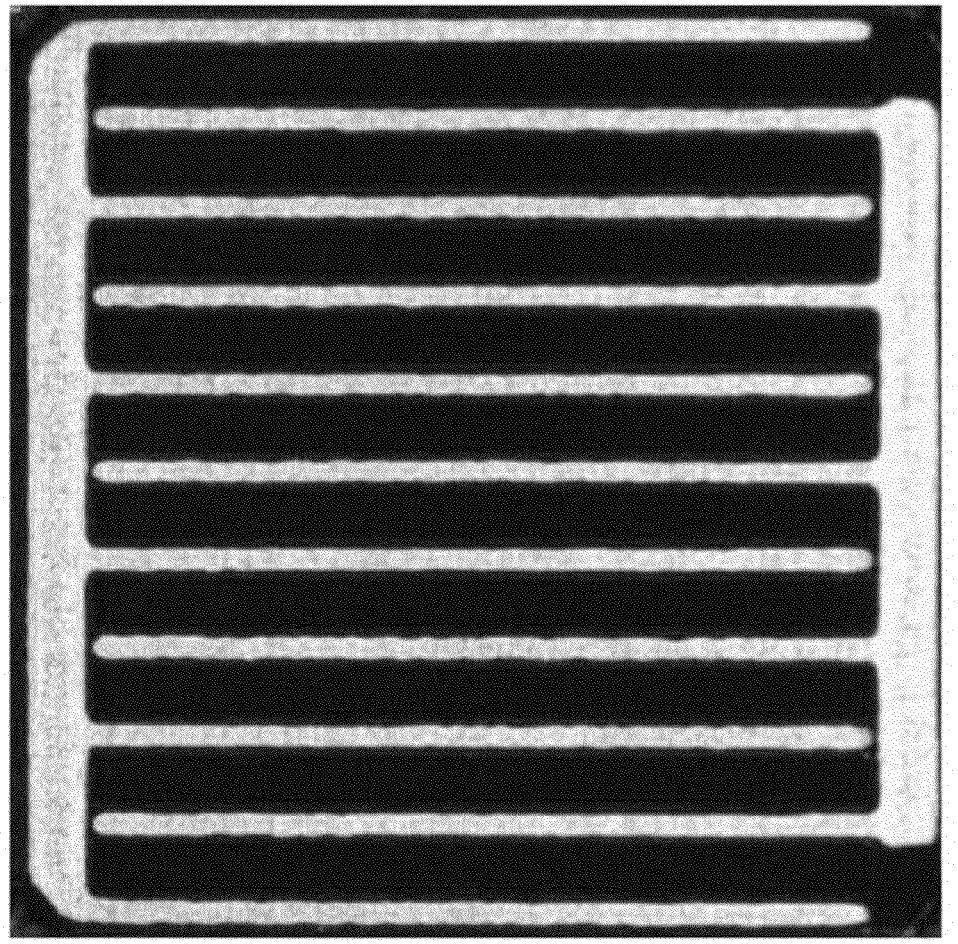
FIG. 5 is photograph of first electrodes and second electrodes in the thermoacoustic device of FIG. 1.

Referring to FIG. 5, The plurality of first electrodes 122 and the plurality of second electrodes 124 can be arranged in a staggered manner of "a-b-a-b-a-b . . . ". All the plurality of first electrodes 122 are electrically connected together, and all the plurality of second electrodes 124 are electrically connected together, whereby the sections of the sound wave generator 121 between the adjacent first electrode 122 and the second electrode 124 are in parallel. An electrical signal is conducted in the sound wave generator 121 from the plurality of first electrodes 122 to the plurality of second electrodes 124. By placing the sections in parallel, the resistance of the thermoacoustic device is decreased. Therefore, the driving voltage of the thermoacoustic device can be decreased with the same effect.

The plurality of first electrodes 122 and the plurality of second electrodes 124 can be substantially parallel to each other with a same distance between the adjacent first electrode 122 and the second electrode 124. A number of the plurality of first electrodes 122 and the plurality of second electrodes 124 are alternatively located on the plurality of bulges 128. The sound wave generator 121 between adjacent first electrodes 122 and second electrodes 124 is suspended above the plurality of grooves 126.

To connect the plurality of first electrodes 122 together, and connect the plurality of second electrodes 124 together, a first conducting member 1221 and second conducting member 1241 can be arranged. All the plurality of first electrodes 122 are connected to the first conducting member 1221. All the plurality of second electrodes 124 are connected to the second conducting member 1241. The first conducting member 1221 can be electrically connected to the drain electrode of the switch 13. The second conducting member 1241 can be electrically connected to the common electrode 16. By applying a voltage between the drain electrode of the switch 13 and the common electrode 16, the driving voltage can be applied between the plurality of first electrodes 122 and the plurality of second electrodes 124 through the first conducting member 1221 and the second conducting member 1241.

The first conducting member 1221 and the second conducting member 1241 can be made of the same material as the first electrode 122 and the plurality of second electrodes 124, and can be substantially perpendicular to the first electrodes 122 and the plurality of second electrodes 124.

The sound wave generator 121 is divided by the plurality of first electrodes 122 and the plurality of second electrodes 124 into many sections. The sections of the sound wave generator 121 between the adjacent first electrode 122 and the second electrode 124 are in parallel. An electrical signal is conducted in the sound wave generator 121 from the plurality of first electrodes 122 to the plurality of second electrodes 124.

The thermoacoustic device 10 can be driven by applying a direct current (DC) driving voltage to the plurality of driven electrodes 151 through the driven integrated circuit 15. During the scanning process, the DC driving voltage is applied on the source electrode of the switch 13 by the driven integrated circuit 15, by scanning each line of the plurality of driven electrodes 151 one by one. At the same time, a DC scanning voltage can be applied to the plurality of scanning electrodes 141 through the scanning integrated circuit 14. Then the DC scanning voltage can be applied on the gate electrode of each row of the plurality of the switches 13 one by one. The source electrode and the drain electrode of the switch 13 can be turned on by applying the DC scanning voltage on the gate electrode of the switch 13. The DC driving voltage can be applied to the plurality of the first electrodes 122 through the drain electrode of the plurality of switches 13. Thus the sound wave generator 121 will generate sound wave under the DC driving voltage.

The sound wave generator 121 has a very small heat capacity per unit area. The heat capacity per unit area of the sound wave generator 121 is less than $2\times10^{-4}$ J/cm$^2$*K. The sound wave generator 121 can be a conductive structure with a small heat capacity per unit area and a small thickness. The sound wave generator 121 can have a large specific surface area for causing the pressure oscillation in the surrounding medium by the temperature waves generated by the sound wave generator 121. The sound wave generator 121 can be a free-standing structure. The term "free-standing" includes, but is not limited to, a structure that does not have to be supported by a substrate and can sustain the weight of it when it is hoisted by a portion thereof without any significant damage to its structural integrity. The suspended part of the sound wave generator 121 will have a better heat exchange with the surrounding medium (e.g., air) from both sides of the sound wave generator 121. The sound wave generator 121 is a thermoacoustic film.

The sound wave generator 121 can be or include a free-standing carbon nanotube structure. The carbon nanotube structure may have a film structure. The thickness of the carbon nanotube structure may range from about 0.5 nanometers to about 1 millimeter. The carbon nanotubes in the carbon nanotube structure are combined by van der Waals attractive force therebetween. The carbon nanotube structure has a large specific surface area (e.g., above 30 m$^2$/g). The larger the specific surface area of the carbon nanotube structure, the smaller the heat capacity per unit area. The smaller the heat capacity per unit area, the higher the sound pressure level of the sound produced by the sound wave generator 121.

The carbon nanotube structure can include at least one carbon nanotube film, a plurality of carbon nanotube wires, or a combination of carbon nanotube film and the plurality of carbon nanotube wires. The carbon nanotube film can be a drawn carbon nanotube film formed by drawing a film from a carbon nanotube array capable of having a film drawn therefrom. The heat capacity per unit area of the drawn carbon nanotube film can be less than or equal to about $1.7\times10^{-6}$ J/cm$^2$*K. The drawn carbon nanotube film can have a large specific surface area (e.g., above 100 m$^2$/g). In one embodiment, the drawn carbon nanotube film has a specific surface area in the range from about 200 m$^2$/g to about 2600 m$^2$/g. In one embodiment, the drawn carbon nanotube film is a pure carbon nanotube structure consisting of a plurality of carbon nanotubes, and has a specific weight of about 0.05 g/m$^2$.

The thickness of the drawn carbon nanotube film can be in a range from about 0.5 nanometers to about 100 nanometers. If the thickness of the drawn carbon nanotube film is small enough (e.g., smaller than 10 μm), the drawn carbon nanotube film is substantially transparent.

Figure 6:
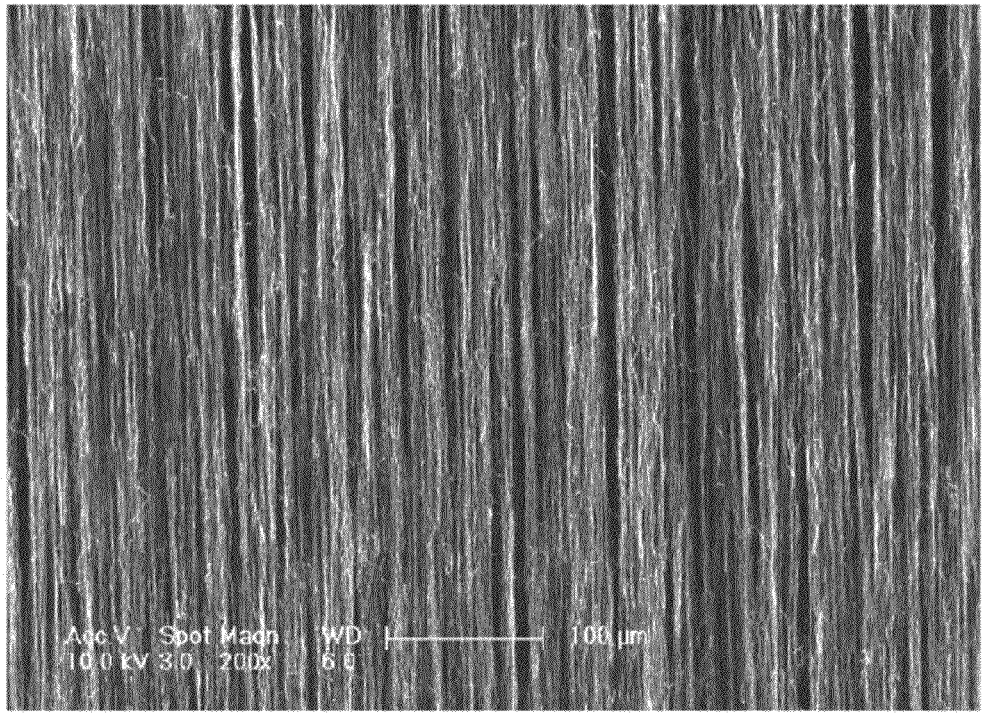
FIG. 6 is a schematic view of a carbon nanotube film in the thermoacoustic device of FIG. 1.

Referring to FIG. 6, the drawn carbon nanotube film includes a plurality of successive and oriented carbon nanotubes joined end-to-end by van der Waals attractive force therebetween. The carbon nanotubes in the drawn carbon nanotube film can be substantially oriented along a single direction and substantially parallel to the surface of the carbon nanotube film. Furthermore, an angle β can exist between the oriented direction of the carbon nanotubes in the drawn carbon nanotube film and the extending direction of the plurality of grooves 126, and $0\leq\beta\leq90°$. In one embodiment, the oriented direction of the plurality of carbon nanotubes is substantially perpendicular to the extending direction of the plurality of grooves 126. As can be seen in FIG. 6, some variations can occur in the drawn carbon nanotube film. The drawn carbon nanotube film is a free-standing film. The drawn carbon nanotube film can be formed by drawing a film from a carbon nanotube array capable of having a carbon nanotube film drawn therefrom. Furthermore, the plurality of carbon nanotubes is substantially parallel with the first face 101.

The carbon nanotube structure can include more than one carbon nanotube film. The carbon nanotube films in the carbon nanotube structure can be coplanar and/or stacked. Coplanar carbon nanotube films can also be stacked upon other coplanar films. Additionally, an angle can exist between the orientation of carbon nanotubes in adjacent films, stacked, and/or coplanar. Adjacent carbon nanotube films can be combined by only van der Waals attractive force therebetween without the need of an additional adhesive. The number of the layers of the carbon nanotube films is not limited. However, as the stacked number of the carbon nanotube films increases, the specific surface area of the carbon nanotube structure will decrease. A large enough specific surface area (e.g., above 30 m$^2$/g) must be maintained to achieve an acceptable acoustic volume. An angle θ between the aligned directions of the carbon nanotubes in the two adjacent drawn carbon nanotube films can range from about 0 degrees to about 90 degrees. Spaces are defined between two adjacent carbon nanotubes in the drawn carbon nanotube film. If the angle θ between the aligned directions of the carbon nanotubes in adjacent drawn carbon nanotube films is larger than 0 degrees, a microporous structure is defined by the carbon nanotubes in the sound wave generator 121. The carbon nanotube structure in an embodiment employing these films will have a plurality of micropores. Stacking the carbon nanotube films will add to the structural integrity of the carbon nanotube structure.

In some embodiments, the sound wave generator 121 is a single drawn carbon nanotube film drawn from the carbon nanotube array. The drawn carbon nanotube film has a thickness of about 50 nanometers, and has a transmittance of visible light in a range from 67% to 95%.

In other embodiments, the sound wave generator 121 can be or include a free-standing carbon nanotube composite structure. The carbon nanotube composite structure can be formed by depositing at least a conductive layer on the outer surface of the individual carbon nanotubes in the above-described carbon nanotube structure. The carbon nanotubes can be individually coated or partially covered with conductive material. Thereby, the carbon nanotube composite structure can inherit the properties of the carbon nanotube structure such as the large specific surface area, the high transparency, the small heat capacity per unit area. Further, the conductivity of the carbon nanotube composite structure is greater than the pure carbon nanotube structure. Thereby, the driving voltage of the sound wave generator 121 using a coated carbon nanotube composite structure will be decreased. The conductive material can be placed on the carbon nanotubes by using a method of vacuum evaporation, spattering, chemical vapor deposition (CVD), electroplating, or electroless plating.

The first electrode 122 and the second electrode 124 are in electrical contact with the sound wave generator 121, and input electrical signals into the sound wave generator 121.

In one embodiment, the sound wave generator 121 is a drawn carbon nanotube film drawn from the carbon nanotube array, and the carbon nanotubes in the carbon nanotube film are aligned along a direction from the first electrode 122 to the second electrode 124. The first electrode 122 and the second electrode 124 can each have a length greater than or equal to the carbon nanotube film width.

Furthermore, a heat sink (not shown) can be located on the substrate 11, and the heat produced by the sound wave generator 121 can be transferred into the heat sink and the temperature of the sound wave generator 121 can be reduced.

The sound wave generator 121 is driven by electrical signals and converts the electrical signals into heat energy. The heat capacity per unit area of the carbon nanotube structure is extremely small, and thus, the temperature of the carbon nanotube structure can change rapidly. Thermal waves, which are propagated into the surrounding medium, are obtained. Therefore, the surrounding medium, such as ambient air, can be heated at a certain frequency. The thermal waves produce pressure waves in the surrounding medium, resulting in sound wave generation. In this process, it is the thermal expansion and contraction of the medium in the vicinity of the sound wave generator 121 that produces sound. The operating principle of the sound wave generator 121 is the "optical-thermal-sound" conversion.

Figure 7:
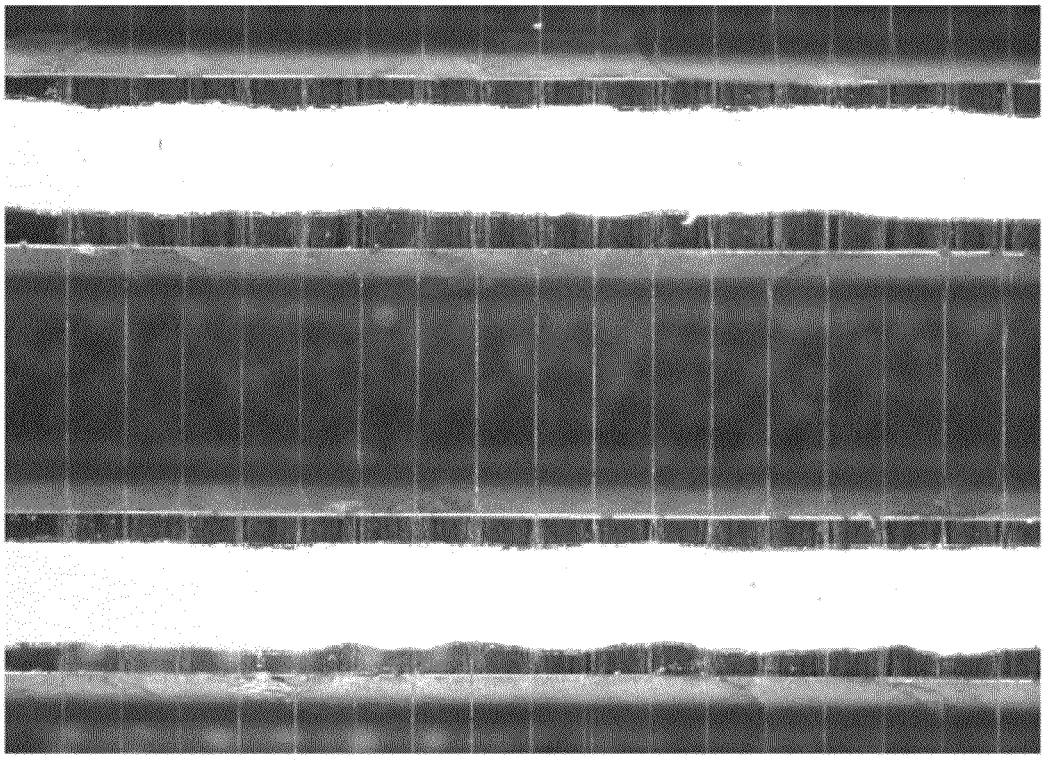
FIG. 7 shows a photomicrograph of a carbon nanotube wire soaked by an organic solution.

Referring to FIG. 7, the carbon nanotube structure can also include a plurality of carbon nanotube wires. The plurality of carbon nanotube wires is intersected with the plurality of grooves 126. In one embodiment, the plurality of carbon nanotube wires is substantially perpendicular to the plurality of grooves 126. Each of the plurality of carbon nanotube wires includes a plurality of carbon nanotubes, and the extending direction of the plurality of carbon nanotubes is substantially parallel with the carbon nanotube wire. The plurality of carbon nanotube wires is suspended on the plurality of grooves 126.

A distance between adjacent two carbon nanotube wires ranges from about 1 micrometer to about 200 micrometers, such as about 50 micrometers, and about 150 micrometers. In one embodiment, the distance between adjacent carbon nanotube wires is about 120 micrometers. A diameter of the carbon nanotube wire ranges from about 0.5 nanometers to about 100 micrometers. In one embodiment, the distance between adjacent carbon nanotube wires is about 120 micrometers, and the diameter of the carbon nanotube wire is about 1 micrometer.

Figure 8:
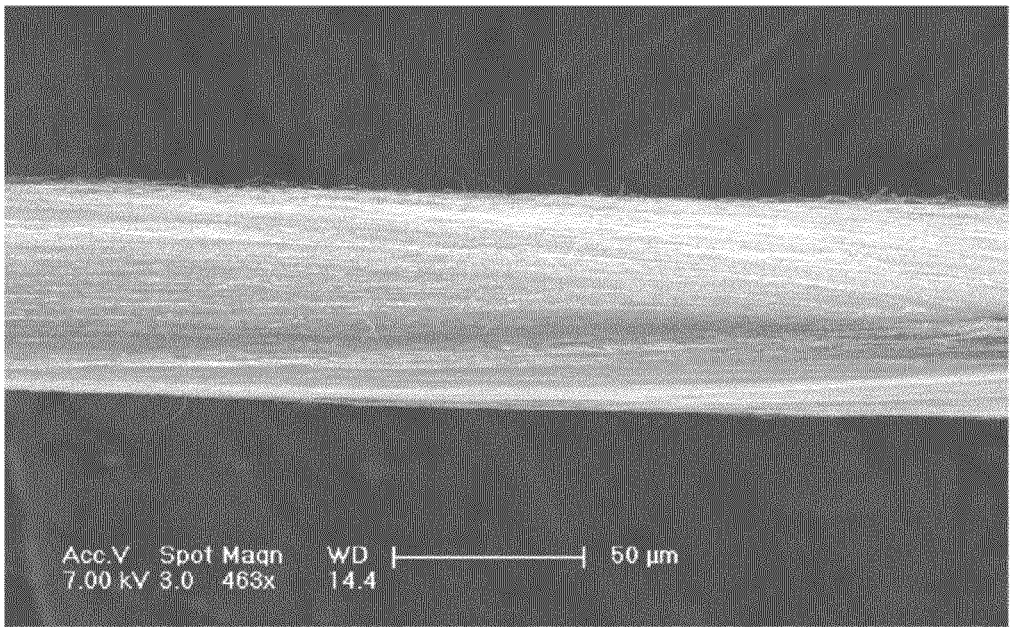
FIG. 8 shows a scanning electron microscope (SEM) image of an untwisted carbon nanotube wire.

The carbon nanotube wire can be untwisted or twisted. Treating the drawn carbon nanotube film with a volatile organic solvent can form the untwisted carbon nanotube wire. Specifically, the organic solvent is applied to soak the entire surface of the drawn carbon nanotube film. During the soaking, adjacent parallel carbon nanotubes in the drawn carbon nanotube film will bundle together, due to the surface tension of the organic solvent as it volatilizes, and thus, the drawn carbon nanotube film will be shrunk into untwisted carbon nanotube wire. Referring to FIG. 8, the untwisted carbon nanotube wire includes a plurality of carbon nanotubes substantially oriented along a same direction (i.e., a direction along the length of the untwisted carbon nanotube wire). The carbon nanotubes are substantially parallel to the axis of the untwisted carbon nanotube wire. More specifically, the untwisted carbon nanotube wire includes a plurality of successive carbon nanotube segments joined end to end by van der Waals attractive force therebetween. Each carbon nanotube segment includes a plurality of carbon nanotubes substantially parallel to each other, and combined by van der Waals attractive force therebetween. The carbon nanotube segments can vary in width, thickness, uniformity, and shape. Length of the untwisted carbon nanotube wire can be arbitrarily set as desired. A diameter of the untwisted carbon nanotube wire ranges from about 0.5 nm to about 100 μm.

Figure 9:
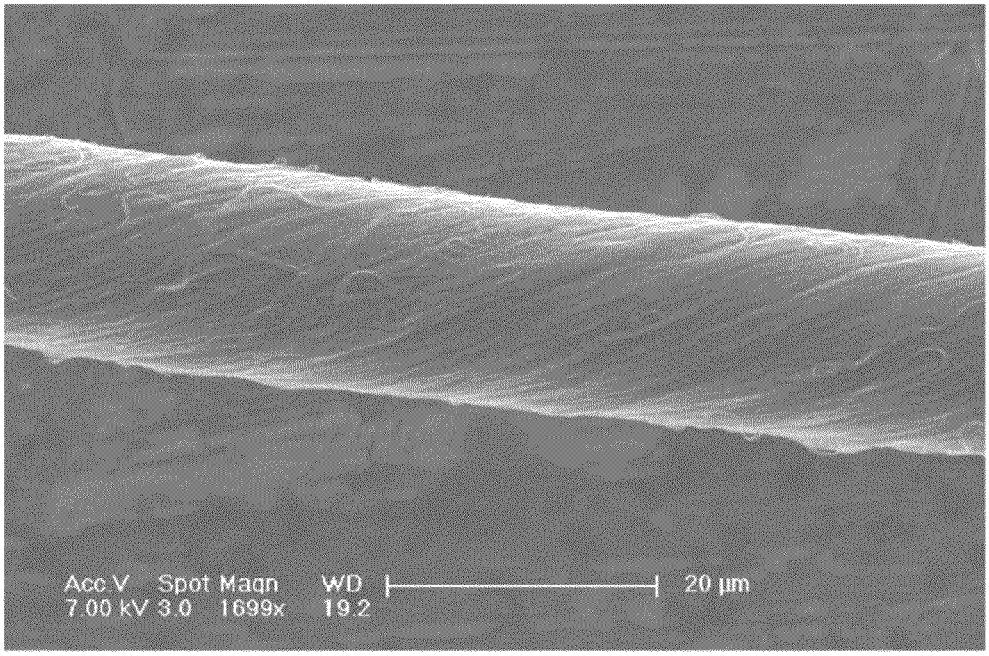
FIG. 9 shows a SEM image of a twisted carbon nanotube wire.

The twisted carbon nanotube wire can be formed by twisting a drawn carbon nanotube film using a mechanical force to turn the two ends of the drawn carbon nanotube film in opposite directions. Referring to FIG. 9, the twisted carbon nanotube wire includes a plurality of carbon nanotubes helically oriented around an axial direction of the twisted carbon nanotube wire. More specifically, the twisted carbon nanotube wire includes a plurality of successive carbon nanotube segments joined end to end by van der Waals attractive force therebetween. Each carbon nanotube segment includes a plurality of carbon nanotubes substantially parallel to each other, and combined by van der Waals attractive force therebetween. The length of the carbon nanotube wire can be set as desired. A diameter of the twisted carbon nanotube wire can be from about 0.5 nm to about 100 μm. Further, the twisted carbon nanotube wire can be treated with a volatile organic solvent after being twisted. After being soaked by the organic solvent, the adjacent paralleled carbon nanotubes in the twisted carbon nanotube wire will bundle together, due to the surface tension of the organic solvent as the organic solvent volatilizes. The specific surface area of the twisted carbon nanotube wire will decrease, while the density and strength of the twisted carbon nanotube wire will be increased. The deformation of the sound wave generator 121 can be avoided during working, and the distortion degree of the sound wave can be reduced.

The thermoacoustic device 10 has many advantages. First, the width of the groove 126 is equal to or greater than 0.2 millimeters and smaller than or equal to 1 millimeter, thus the carbon nanotube structure can be effectively protected from being broken. Second, the material of the substrate 11 is silicon material, thus the thermoacoustic device 10 can be easily fabricated via traditional process, and the size of the thermoacoustic device 10 can be reduced. A small-sized thermoacoustic speaker (such as smaller than 1 square centimeters) can be obtained. Third, the substrate 11 has good thermal conductivity, and the heat sink can be omitted. Fourth, the thermoacoustic device 10 can be fabricated by traditional semiconductor manufacturing processes, thus the thermoacoustic device 10 can be easily integrated with other elements such as an IC chip, and suitable for small devices.

Depending on the embodiment, certain of the steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

It is to be understood that the above-described embodiments are intended to illustrate rather than limit the invention. Variations may be made to the embodiments without departing from the spirit of the invention as claimed. Any elements discussed with any embodiment are envisioned to be able to be used with the other embodiments. The above-described embodiments illustrate the scope of the invention but do not restrict the scope of the invention.

What is claimed is:

1. A thermoacoustic device, the thermoacoustic device comprising:

a substrate having a first surface and a second surface opposite to the first surface;

a plurality of thermoacoustic units located on the first surface of the substrate, each of the plurality of thermoacoustic units comprising a first electrode, a second electrode, and a sound wave generator electrically connected in series between the first electrode and the second electrode;

a plurality of switches, each of the plurality switches is electrically connected to the first electrode of each of the plurality of thermoacoustic units;

a plurality of driving electrodes;

a driving integrated circuit electrically connected in series between the first electrode and the each of the plurality of switches through a corresponding driving electrode;

a plurality of scanning electrodes;

a scanning integrated circuit electrically connected to the each of the plurality of switches through a corresponding scanning electrode; and a common electrode electrically connected to the second electrode of each of the plurality of thermoacoustic units.

2. The thermoacoustic device of claim 1, wherein each of the plurality of switches is a triode.

3. The thermoacoustic device of claim 2, wherein each of the plurality of switches is a field effect transistor or a thin film transistor.

4. The thermoacoustic device of claim 3, wherein the thin film transistor comprises a source electrode electrically connected to the driving electrode, a drain electrode electrically connected to the thermoacoustic unit, and a gate electrode electrically connected to the scanning electrode.

5. The thermoacoustic device of claim 4, wherein the drain electrode is electrically connected to the first electrode of each of the plurality of thermoacoustic units, and each of the plurality of thermoacoustic units is electrically connected in series between the drain electrode of one of the plurality of switches and the common electrode.

6. The thermoacoustic device of claim 5, wherein each of the plurality of thermoacoustic unit is capable of being driven by a direct current driving voltage applied between the drain electrode and the common electrode.

7. The thermoacoustic device of claim 6, wherein the direct current driving voltage is applied on the source electrode of one of the plurality of switches through the driven integrated circuit.

8. The thermoacoustic device of claim 7, wherein the direct current driving voltage is applied on the drain electrode by turning on one of the plurality of switches by applying a direct current scanning voltage on the gate electrode.

9. The thermoacoustic device of claim 1, wherein a size of the substrate ranges from about 25 square millimeters to about 100 square millimeters.

10. The thermoacoustic device of claim 1, wherein the first surface defines a plurality of grooves substantially parallel with and spaced from each other.

11. The thermoacoustic device of claim 10, wherein a portion of the sound wave generator is suspended on the plurality of grooves.

12. The thermoacoustic device of claim 10, wherein a width of each of the plurality of grooves ranges from about 0.2 millimeters to about 1 millimeter.

13. The thermoacoustic device of claim 10, wherein a depth of each of the plurality of grooves ranges from about 100 micrometers to about 200 micrometers.

14. The thermoacoustic device of claim 1, wherein the sound wave generator comprises a free-standing carbon nanotube structure.

15. The thermoacoustic device of claim 14, wherein the carbon nanotube structure comprises a plurality of carbon nanotubes substantially oriented along the same direction and intersected with the plurality of grooves.

16. The thermoacoustic device of claim 14, wherein the carbon nanotube structure comprises a plurality of carbon nanotube wires extending along the same direction, and the plurality of carbon nanotube wires is substantially parallel with and spaced from each other.

17. The thermoacoustic device of claim 16, wherein the plurality of carbon nanotube wires is intersected with the plurality of plurality of grooves.

18. The thermoacoustic device of claim 16, wherein each of the plurality of carbon nanotube wires comprises a plurality of carbon nanotubes substantially parallel with the extending direction of the carbon nanotube wire.

19. The thermoacoustic device of claim 16, wherein each of the plurality of carbon nanotube wires comprises a plurality of carbon nanotubes helically oriented around an axis of the carbon nanotube wire.

20. The thermoacoustic device of claim 16, wherein a distance between adjacent carbon nanotube wires ranges from about 0.1 micrometers to about 200 micrometers.

* * * * *